United States Patent [19]

Sigler

[11] Patent Number: 4,635,976

[45] Date of Patent: Jan. 13, 1987

[54] SLIDING WINDOW LOCK

[76] Inventor: Jeffrey J. Sigler, 13 Carmichael Court, Kanata, Ontario, Canada, K2K 1K1

[21] Appl. No.: 580,342

[22] Filed: Feb. 15, 1984

[51] Int. Cl.[4] ..... E05C 5/02

[52] U.S. Cl. ..... 292/57; 70/95; 292/67; 292/DIG. 15; 292/DIG. 46

[58] Field of Search ..... 70/95, 90, 91, 94, DIG. 79; 292/67, DIG. 15, DIG. 46, DIG. 47, 59, 60, 68, 57, 63

[56] References Cited

U.S. PATENT DOCUMENTS

| | | | |
|---|---|---|---|
| 777,099 | 12/1904 | Hillyard | 292/60 |
| 897,105 | 8/1908 | Ingebo | 292/DIG. 46 |
| 906,452 | 12/1908 | McCleer | 292/DIG. 46 |
| 1,061,509 | 5/1913 | Troetel | 292/60 |
| 1,822,110 | 9/1931 | Raymond | 292/60 |
| 1,904,291 | 4/1933 | Neilson et al. | 292/67 |
| 2,546,535 | 3/1951 | Barry . | |
| 2,589,878 | 3/1952 | Shapiro | 292/60 |
| 2,676,824 | 4/1954 | Gessler | 292/162 X |
| 2,900,679 | 8/1959 | Migneault et al. | 292/DIG. 46 |
| 2,961,263 | 11/1960 | Ahlgren | 292/DIG. 46 |
| 3,171,678 | 3/1965 | Peras | 292/DIG. 46 |
| 3,357,732 | 12/1967 | Seal | 292/60 |
| 3,378,293 | 4/1968 | Silk . | |
| 4,017,105 | 4/1977 | Paxton . | |

FOREIGN PATENT DOCUMENTS

| | | | |
|---|---|---|---|
| 547 | of 1870 | Canada . | |
| 6219 | of 1875 | Canada . | |
| 547454 | 10/1957 | Canada . | |
| 669575 | 8/1963 | Canada . | |
| 797,708 | 10/1968 | Canada . | |
| 828023 | 11/1969 | Canada . | |
| 886317 | 11/1971 | Canada . | |
| 525241 | 5/1921 | France | 292/60 |
| 1102953 | 5/1955 | France | 292/60 |
| 781063 | 8/1957 | United Kingdom | 292/68 |

*Primary Examiner*—Robert L. Wolfe
*Assistant Examiner*—Lloyd A. Gall
*Attorney, Agent, or Firm*—Merchant, Gould, Smith, Edell, Welter & Schmidt

[57] ABSTRACT

A lock assembly for a horizontal sliding sashless window is provided. The lock assembly comprises a block having anchor means, and pivotal attachment means. The block has a vertical lock surface formed to block the leading edge of the sliding pane when the sliding pane is in closed position, with clearance to permit pivotal movement of the lock surface away from the sliding pane. The pivotal attachment means attaches the block to the sill of the window at a position forwardly offset from the lock surface of the block, and provides for limited vertical movement of the block away from the sill. The anchor means is selectably engageable and releasable by the combination of pivoting the block and by motion away from the sill. The lift and twist motion of the lock assembly does not limit the height of the block or the depth of the anchor means.

26 Claims, 10 Drawing Figures

SLIDING WINDOW LOCK

BACKGROUND OF THE INVENTION

This invention relates to lock assemblies for securing sliding closures against forced entry, and more particularly to a lock assembly for securing sashless horizontal sliding windows.

BACKGROUND OF THE INVENTION

Sashless sliding windows are notorious for offering poor resistance to forced entry. It is often possible to open and gain entry through such windows, without breaking the glass, by manipulating the locking means and/or window assembly with a knife, spatula, coat hanger or the like. It is, of course, difficult to lock a sashless window, since this type of window lacks a wooden or metal sash or other means for conveniently attaching part of a locking assembly.

Rather primitive expedients have been used in attempts to effectively secure sashless windows. For instance, it is known to wedge a stick of suitable length along the bottom of the fixed panel between the window jamb and the leading edge of the sliding panel. A locking means of this nature not only provides inadequate security against forced entry by professional burglars, but is also bulky, unsightly and prone to being misplaced in time.

Somewhat less primitive locking means are commercially available. A condensation lock having a surface which pushes the sliding pane against the fixed pane is one such means. One type of condensation lock has a U-shaped plastic body which is designed to be pivoted by hand towards the face of the sliding pane, to force that pane against the fixed pane. A window so locked can, however, be pried open by inserting a screw driver or the like between the jamb and the sliding pane so as to apply a sufficient lateral force (a force directed along the plane of sliding action) to the sliding pane to force it past the surface of contact of the condensation lock.

Another common commercially available lock means for a sashless window comprises a U-shaped body designed to overlap both sides of the sliding pane at a vertical edge, the U-shaped body having an inwardly directed flange which cooperates with a lever attached to the inside of the jamb to provide resistance to a lateral force. This type of lock can, however, be circumvented in a number of ways. For instance, the portion of the lock assembly affixed to the glass pane can usually be forceably slid down or up past the point of contact with the lever portion.

Also known is a lever-action type of lock which is designed to be mounted on the inside of the window sill near the area of pane overlap, having a surface which blocks the leading edge of the sliding pane against lateral movement thereof. A lock of this nature is disclosed in Canadian Pat. No. 547,454, which issued to Harold Sisson on Oct. 15, 1957. This type of lever-action design suffers, however, from a number of apparent drawbacks. Because this type of lock must be manipulated by means of a lever type action, i.e. one end of the major body being raised while the other end remains virtually satisfactory, certain dimensions of the lock components are limited, due to clearance problems. The height of the major body is necessarily limited to only a fraction of an inch, since an overly large major body would not clear the edge of the sliding pane during the pivoting operation. Also limited is the depth of the anchor located at the end of the major body remote from the pivot point, due to limited clearance during operation between the bottom of the one end of the major body and the top of the sill or mounting bracket. These limitations reduce the effectiveness of the lever-action lock mechanism against forced entry. The Sisson lock also has the disadvantage of being composed of a large number of component parts.

SUMMARY OF THE INVENTION

It has been found that the disadvantages of known lock assemblies for sashless horizontal sliding windows may be overcome by a lock assembly which utilizes a lift and twist type of motion, since such a motion does not limit the height of the major body or the depth of the anchor means.

Accordingly, the present invention provides a lock assembly for a sliding closure having a fixed panel and a sliding panel mounted for horizontal sliding movement in a frame. The lock assembly comprises a block having a vertical lock surface formed to engage the leading edge of the sliding panel when the sliding panel is in closed position, with clearance to permit pivotal movement of the lock surface of the block away from the sliding panel thereby to permit free sliding movement of the sliding panel, and pivotal attachment means for pivotally attaching the block at a position forwardly offset from the lock surface thereof to a horizontal surface of the frame and for providing limited vertical movement of the block away from the horizontal surface. The block has an anchor means for releasably engaging a mating means in the frame offset from the horizontal surface thereof. The anchor means is selectably engageable and releasable by the combination of pivoting motion of the block and motion toward and away from the horizontal surface. The lock surface of the block blocks the leading edge of the sliding panel to prevent any substantial sliding movement thereof when the anchor means is engaged. Pivotal movement of the block is restrained when the anchor means is engaged.

The present invention also provides a lock assembly for a horizontal sliding sashless window pane, one end of which overlaps, when closed, an adjacent end of a fixed sashless pane, in a frame including a sill in which the sliding sashless pane slides. The lock assembly comprises a block, a pivot mechanism, a spring and an anchor. The block has a height greater than the vertical distance through which the sliding pane is free to move, and is formed with a horizontal shoulder, and has a vertical blocking surface of width substantially equal to the width of the sliding pane, for engaging the leading edge of the sliding pane with clearance sufficient to permit pivotal motion of the vertical blocking surface away from and out of engagement with the leading edge of the sliding pane, and has a vertical neck surface extending rearwardly from the shoulder for engaging the side of the sliding pane over a portion of its length from its leading edge. The pivot mechanism pivotally engages the block at a location forward of the vertical blocking surface for fixed pivotal attachment to the sill forwardly of and offset from the leading edge of the sliding pane. The pivot end of the block is provided with mating vertical sliding surfaces which permit limited vertical sliding movement of the block away from the sill, and with a stop for restraining vertical sliding movement of the block away from the sill through more than a predetermined maximum distance. The spring engages the pivot mechanism and the block to bias the block toward the sill and to resist vertical sliding movement of the block away from the sill. The anchor is formed in or fixed to the block rearwardly of the pivot mechanism, and has an anchoring surface for releasably engaging a mating surface in this sill to restrain pivotal movement of the block. The anchor is released from engagement with the sill when the block is slid away from the sill along the vertical sliding surface of the pivot mechanism through a distance less than the predetermined maximum distance.

The invention will now be described, by way of example only, with reference to the following drawings, wherein like numerals refer to like parts throughout, and in which.

DETAILED DESCRIPTION OF THE PREFERRED EMBODIMENT

It is to be understood when construing this disclosure and the claims appended thereto that all references therein to terms suggesting relative positioning of various components of the lock assembly vis-a-vis a window assembly, such as "leading edge", "rearwardly", "vertical" and "forwardly offset", are expressed relative to the positioning of the lock assembly when it is mounted on a window assembly oriented in its most common conventional configuration. Since the window assembly could conceivably be oriented otherwise, these terms are meant to be construed relatively, not absolutely, in both this disclosure and the claims appended hereto.

Figure 1:
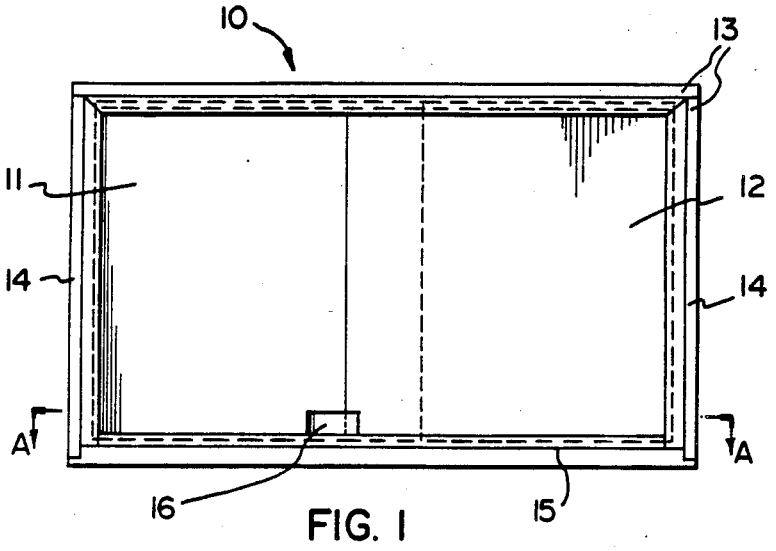
FIG. 1 is an elevational view of a conventional sashless horizontal sliding window with the lock assembly of the present invention shown mounted on the sill thereof.

FIG. 1 illustrates a sashless horizontal sliding window designated generally as 10, which comprises fixed sashless pane 11 and sliding sashless pane 12 mounted in a frame 13 having jambs 14 and sill 15 upon which is mounted the lock assembly of the present invention designated generally as 16.

Figure 2:
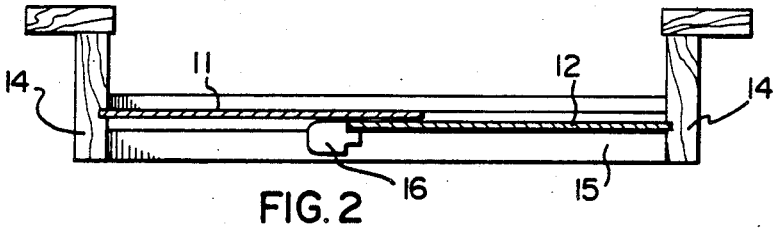
FIG. 2 is a plan sectional view taken along line II—II of FIG. 1.

FIG. 2 illustrates the approximate mounting position of lock assembly 16 on sill 15. Sliding pane 12 is in its closed position, and lock assembly 16 is in its locked or anchored position.

Figure 3:
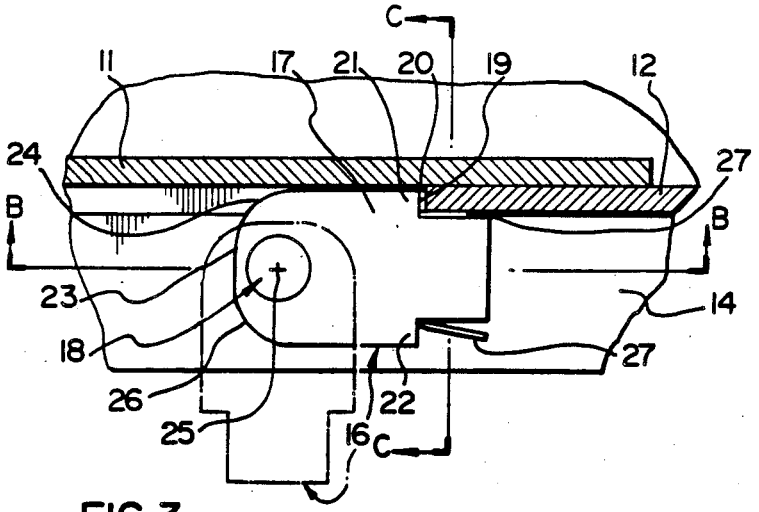
FIG. 3 is a top plan view of the lock assembly of the present invention shown mounted on the sill of a window.

FIG. 3 is a top view of the preferred embodiment of the present invention. Lock assembly 16 is shown attached to sill 15 in its locked or anchored position by the solid lines, and in its opened position by the dotted lines. Lock assembly 16 comprises block 16, pivotal attachment means 18, and anchor means 31 not shown in FIG. 3 but shown in FIG. 4, which is a perspective view of block 17.

Figure 4:
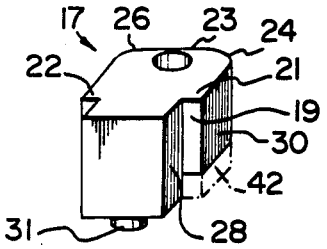
FIG. 4 is a perspective view of the block element of the lock assembly.

Referring now to FIGS. 3 and 4, block 17 is formed with shoulder 21 which defines vertical blocking or lock surface 19. Lock assembly 16 should be mounted on sill 15 such that when the sliding pane 12 is completely closed and lock assembly 16 is in its anchored position, lock surface 19 engages the leading edge 20 of the sliding pane, with clearance sufficient to permit pivotal motion of the lock surface 19 away from and out of engagement with leading edge 20. Such clearance between lock surface 19 and leading edge 20 should be generally a small fraction of an inch, depending upon the width of lock surface 19, to allow the corner of lock surface 19 to clear the corner of leading edge 20, as block 17 is pivoted between its anchored and open positions.

Block 17 is preferably provided with two symmetrically formed and located shoulders 21 and 22. Shoulder 21 provides a locking surface for a sliding pane mounted to the right of the fixed pane, when viewed from inside the dwelling, as shown in FIGS. 1–3, whereas shoulder 22 provides a locking surface for a sliding pane mounted to the left of the fixed pane, when similarly viewed. Lock assembly 16 may therefore be used for either type of window, and as well, it may be mounted either on the bottom sill, as shown in the figures, or on the top sill (i.e. the top horizontal member of the window frame which is also known as the head), virtually out of sight. Such symmetry also allows a window to be doubly secured by two lock assemblies, one mounted on the head and the other mounted on the sill.

Forward end 23 of the block assembly is provided with rounded or beveled corner 24 which allows block 17 to be pivoted in a horizontal plane about pivot point 25 without interference from fixed plane 11. Corner 26 is provided for similar reasons to allow block 17 to be mounted and pivoted for left-to-right opening windows.

Block 17 preferably includes condensation lock means 27 as shown in FIG. 3, which may comprise a resilient pad or flap extending from lock surface 19. Block 17 is shown in FIG. 4 without such condensation lock means.

As shown in FIG. 4, block 17 may comprise vertical neck surface 28 extending rearwardly (i.e. away from the pivot point) from shoulder 21. Neck surface 28 engages a portion of the side of sliding pane 12 when lock assembly 16 is in its anchor position, either by direct physical contact between itself and sliding pane 12, or by pressing condensation block means 27 into physical contact with sliding pane 12 as shown in FIG. 3.

Block 17 may further include vertical head surface 30 which is formed to engage, in the sense of being closely adjacent to or bearing against, a portion of the side of fixed plane 11, when block 17 is in its anchor position.

The purpose of neck surface 28 and head surface 30 is to provide resistance against movement of the sliding and fixed panels respectively towards the lock assembly in the direction perpendicular to the plane of sliding movement of the sliding window (i.e. "inward" movement).

In order to ensure that neck surface 28 and head surface 30 properly engage the sliding and fixed panels respectively, the width of lock surface 19 should be selected to be substantially the same as the width of leading edge 20 of sliding pane 12. In those cases in which sliding pane 12 is not sashless but includes a sash, the width of surface 19 should approximately equal the width of the sash.

The height of surfaces 19, 28 and 30 of block 17 are preferably selected to be between ½" and 1", and must in any event be high enough to prevent the panes from being slid inwardly over the top of the lock assembly when it is in its anchored position. Having a relatively thick block (i.e. relatively high lock, neck and head surfaces) increases the effectiveness of the lock assembly against forced entry, for several reasons. The relatively large surface area of contact between block 17 and leading edge 20 provided by surface 19 spreads out the force generated by an attempt at forced entry, thus reducing the pressure and the chances of the glass pane fracturing against the lock surface. A high block also reduces the possibility of the glass being slid inwardly over the top of the lock assembly itself. A high block is also convenient in that it allows for the block itself to be used as a handle for manipulating the locked assembly. A large block also acts as an effective visual deterrent against forced entry.

Block 17 is to be mounted on sill 15 such that pivot point 25 is forwardly offset from the leading edge 20 of sliding pane 12 when same is in closed position, in the sense that the pivot point 25 is situated alongside the fixed panel 11 rather than alongside the sliding panel 12. It is believed that the forward orientation of the pivot point relative to the leading edge of the sliding panel when closed is advantageous over those lock mechanisms, such as the lock disclosed in Canadian Pat. No. 547,454 noted above, having pivot points located rearwardly of the leading edge of the sliding pane when closed, since application of a lateral force to the sliding panel, especially in cases of slight misalignment wherein the blocking surface of the lock is not exactly perpendicular to the plane of the sliding panel, tends to pivot the block of the present invention further towards the fixed panel, rather than away from same as would be the case for mechanisms having a rearward pivot point.

Figure 5:
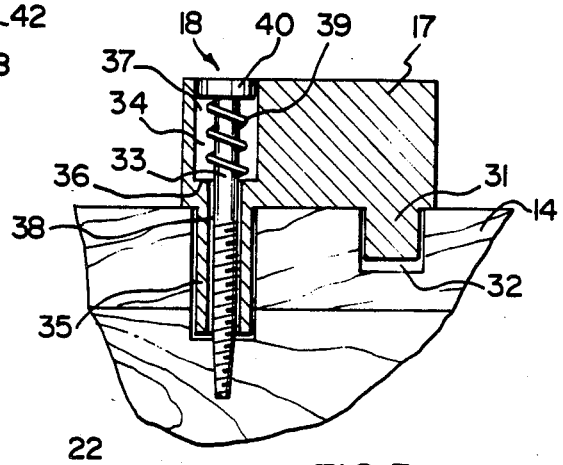
FIG. 5 is a sectional elevational view taken along line V—V of FIG. 3.

Referring now to FIG. 5, anchor means 31 is preferably an anchor peg of circular cross-section formed in the bottom of block 17 rearwardly of pivotal attachment means 18. Anchor means 31 releasably engages a mating means 32 offset from the surface of sill 15. Mating means 32 may be a hole located and dimensioned to accept anchor means 31 when block 17 has been pivoted towards window 10 such that surfaces 19, 28 and 30 engage fixed and sliding panes 11 and 12 as described above. Anchor means 31, when engaged with mating means 32, prevents block 17 from being pivoted away from the window in response to a forced entry attempt. Such engagement also anchors the block 17 against movement thereof in response to a lateral force being applied to the sliding pane 12, or in response to an inwardly directed force being applied to either pane.

The depth of anchor means 31 is preferably from ¼" to ½". Anchor means 31 may, however, be considerably deeper, unlike the corresponding anchor means in a lever-action type of mechanism, whose depth is necessarily limited to only a small fraction of an inch.

Pivotal attachment means shown generally as 18 may include fastener 33 which extends through cavity 34 in a forward portion of block 17 into sill 15, when lock assembly 16 is in its mounted position. The bottom portion of block 17 may be provided with cylindrical anchoring sleeve 35 which surrounds fastener 33. Block 17 may include spring support shoulder 36 which divides cavity 34 into a wider region 37 and a narrower region 38, so as to support spring 39, which is positioned in wider region 37, between shoulder 36 and head 40 of fastener 33. Spring 39 acts to bias block 17 towards sill 15. Fastener 33 may be a conventional wood screw having a flat head, or a wood screw and washer assembly. A hole must be made in sill 15 in order to accommodate anchoring sleeve 35.

The depth of wider region 37 and the nature of spring 39 are selected to allow block 17 to be moved through a predetermined maximum vertical distance, which must be great enough to allow block 17 to be lifted far away from the sill to disengage anchor means 31 from mating means 32.

To operate lock assembly 16 from its anchor position to its open position, a "lift and twist" motion is employed (unless the lock assembly is mounted at the top of the frame, in which case the block must be lowered rather than lifted). That is, referring to FIGS. 3, 5 and 6, lock assembly 16 is moved from its anchored position shown in FIG. 5 to its open position, shown by the dotted lines in FIG. 3, by first moving block 17 vertically a limited distance away from the sill along the longitudinal axis 29 of fastener 33, thereby compressing springs 39 into a compressed state 41 as shown in FIG. 6, such that anchor means 31 clears mating means 32; and by next pivoting block 17 about longitudinal axis 29 away from window assembly 10, to allow sliding pane 12 to be opened without interference with block 17.

It will be appreciated from the above description that pivotal attachment means 18 functions:

(1) to attach block 17 to sill 15;
(2) to bias block 17 against sill 15;
(3) to allow block 17 to be lifted to provide clearance between anchor means 31 and mating means 32;
(4) to allow block 17 to be twisted towards or away from window 10; and
(5) to act as a second anchoring means, in addition to anchor means 31.

Figure 6:
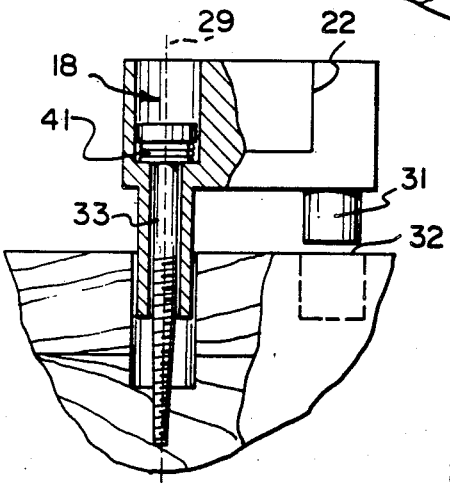
FIG. 6 is a partially cut-out elevational view of the lock assembly shown in its lifted position.
Figure 7:
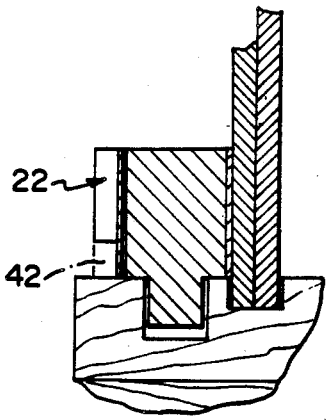
FIG. 7 is a transverse sectional view taken along line VII—VII of FIG. 3.

Referring now to FIGS. 4, 6 and 7, shoulder 21 and shoulder 22 need not necessarily extend completely down the sides of block 17. Rather, it may be preferable, in order to allow the lock assembly 16 to be used in association with certain types of commercially available windows having a track mechanism or other obstruction running the length of at least the fixed pane, that portions 42 of shoulder 22 and shoulder 21 be removed to allow clearance between block 17 and such track mechanism or obstruction.

Figure 8:
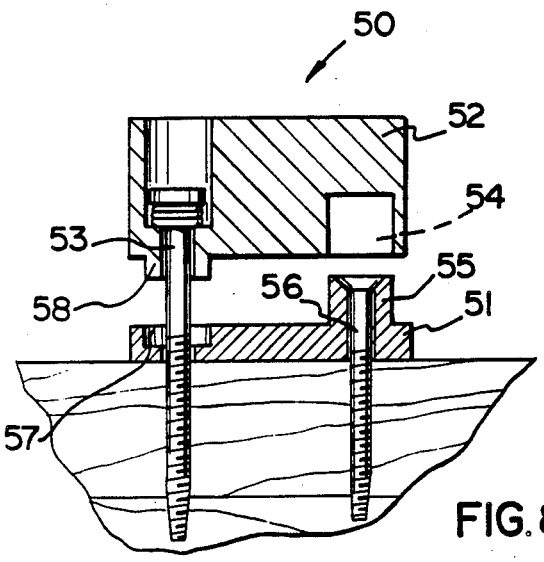
FIG. 8 is an elevational view of an alternative embodiment of the locked assembly, shown in its lifted position.

An alternative embodiment of the lock assembly of the present invention is shown in FIG. 8. Lock assembly designated generally as 50 comprising mounting template 51 in addition to block 52 and pivotal attachment means 53. Block 52 and pivotal attachment means 53 are similar to block 17 and pivotal attachment means 18 respectively of preferred embodiment 16. The anchor means of lock assembly 50 comprises cavity 54 formed in block 52, rather than a peg projecting therefrom as in the case of the preferred embodiment. Cavity 54 is dimensioned to accommodate peg 55 which projects upwardly from mounting template 51. An aperture for accepting a fastener 56 extends through peg 55. Block 52 is provided with anchoring sleeve 58 extending a distance from the block less than the height of template 51, dispensing with the need to provide the sill with a hole to accommodate sleeve 58. Template 51 is provided with aperture 57 dimensioned for sliding and pivoting engagement with anchoring sleeve 58.

Figure 9:
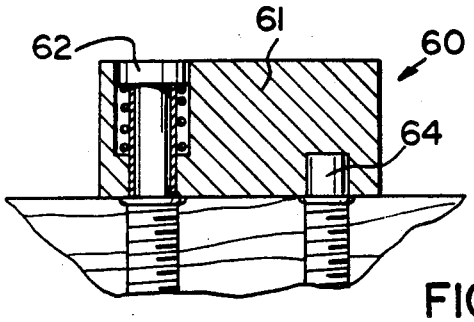
FIG. 9 is a sectional elevational view of a further alternative embodiment of the locked assembly, shown in its anchored position.
Figure 10:
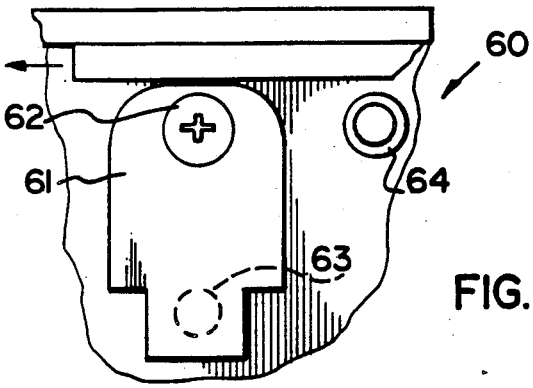
FIG. 10 is a top plan view of the further alternative embodiment, shown in its open position.

A further alternative embodiment of the present invention is illustrated in FIGS. 9 and 10 and is designated generally as 60. Lock assembly 60 comprises block 61, pivotal attachment means 62, anchor means 63, and mating means 64. Block 61 differs from block 17 in that the anchor means 63 of block 61 is a cavity formed therein located rearwardly of the pivot point. Mating means 64 is a male insert which, when installed in the sill, has a portion which projects above the surface of the sill and which is dimensioned to releasably engage cavity 63.

Block 61 also differs from block 17 in that it does not include a structure similar to anchoring sleeve 35. Accordingly, it is not necessary to make (e.g. drill) a hole in the sill to accommodate sleeve 35, as it is in the case of the preferred embodiment. Pivotal attachment means 62 is similar to pivotal attachment means 18.

The particular advantages of each of the above embodiments will be apparent. The preferred embodiment consists of only three component parts, the block, a fastener and a spring. It also includes an integral condensation lock. The alternative embodiment includes a mounting template, which reduces the chances of improperly installing the lock assembly. The further alternative embodiment includes a block of relatively simple construction. The alternative embodiments do not require any sill preparation in the nature of forming anchoring apertures.

A number of further variations and combinations of the three embodiments shown in the figures are possible. For example, sleeve 35 of the preferred embodiment may be dispensed with. Head surface 30 could be eliminated if resistance to inward movement of the sliding pane was not necessary, which may be the case for certain applications. Block 17 need not of course be symmetric, and may be formed with only a single lock surface. Condensation lock means 27 could alternatively extend from neck surface 28, rather than lock surface 19.

Furthermore, while the lock assembly has been illustrated and described with reference to and for use with a sashless horizontal sliding window, it will be readily apparent that it could be used for windows with sashes, and further, with other horizontal sliding closures, such as sliding glass doors. It could also be used to secure sliding closures which are oriented at an angle to the horizontal, or even with sliding closures which are oriented to slide vertically.

It will therefore be apparent to those skilled in the art that various modifications of the embodiments shown and described can be made without departing from the scope of the present invention, which is defined in the claims appended thereto.

I claim:

1. A lock assembly for a sliding closure having a fixed panel (11) and a sliding panel (12) mounted within a frame (13) for sliding movement along a predetermined direction of movement within said frame; said sliding panel (12) movable along said direction between a closed position and an open position with said sliding panel presenting a leading edge (20) generally transverse to said direction of movement; said assembly comprising:

a block (17);

pivot means (18) for pivotally attaching said block (17) to said frame (13) with a pivot axis (25) disposed on a side of said leading edge (20) away from said open position with said pivot axis generally perpendicular to said direction of movement; said block (17) pivotable about said axis between a lock position and an unlocked position;

said block (17) having a lock surface (19) opposing said leading edge (20) when said block (17) is pivoted to said lock position and said sliding panel (12) is in said closed position with said lock surface (19) spaced from said leading edge (20) a distance to present a clearance sized to permit passage of said lock surface (19) through said clearance as said block (17) is pivoted from said lock position to an unlocked position;

anchor means for restraining said block (17) from pivotal movement when said block (17) is in said locked position and comprising cooperating mating elements (31, 32) on said block member and said frame with said elements (31, 32) free to slide relative to one another in a straight path parallel to said pivot axis, said mating elements movable a predetermined stroke between a captured position and a free position with said elements (31, 32) in said free position free to move relative to one another perpendicular to said pivot axis and with said elements (31, 32) in said captured position restrained from movement other than movement in said straight path; and said pivot means including means for moving said block away from said frame in a path parallel to said straight path a distance greater than said stroke.

2. A lock assembly as defined in claim 1, wherein the block also has a vertical neck surface formed to be positioned closely adjacent a portion of the side of the sliding panel when the anchor means is engaged, to provide resistance to movement of the sliding panel in the direction perpendicular to the plane of sliding movement of the sliding closure.

3. A lock assembly as defined in claim 2, wherein the block also has a head surface formed to be positioned closely adjacent a portion of the side of the fixed panel when the anchor means is engaged, to provide resistance to movement of the fixed panel in the direction perpendicular to the plane of sliding movement of the sliding closure.

4. A lock assembly as defined in claim 3, wherein the neck and head surfaces are of a dimension transverse to the direction of sliding movement greater than the vertical distance through which the sliding panel is free to move transverse to the direction of sliding movement.

5. A lock assembly as defined in claim 3, wherein the surfaces are of a transverse dimension greater than about ½".

6. A lock assembly as defined in claim 1, wherein the block is provided with resilient condensation lock means for compression against the sliding panel when the anchor means is engaged, such that the sliding panel is forced into contact with an overlapped portion of the fixed panel.

7. A lock assembly as defined in claim 6, wherein the condensation lock means comprises a resilient flap extending angularly from the lock surface, which is compressed between the sliding panel and the neck surface when the anchor means is engaged.

8. A lock assembly as defined in claim 1, wherein the block also has a head surface formed to be positioned closely adjacent a portion of the side of the fixed panel when the anchor means is engaged, to provide resistance to movement of the fixed panel in the direction perpendicular to the plane of sliding movement of the sliding closure.

9. A lock assembly as defined in claim 1, wherein the lock surface is of a dimension transverse to the direction of sliding movement greater than a distance through which the sliding panel is free to move transverse to the direction of sliding movement.

10. A lock assembly as defined in claim 1, wherein the lock surface is of a transverse dimension greater than about ½".

11. A lock assembly as defined in claim 1, wherein the pivotal attachment means includes spring means for biasing the block towards the captured position.

12. A lock assembly as defined in claim 1, wherein the anchor means is an anchor peg projecting from a surface of the block opposing the frame when the lock assembly is installed on the frame, and the mating means is a hole in the frame dimensioned to accept the anchor peg.

13. A lock assembly as defined in claim 1, wherein the anchor means is a cavity in a surface of the block opposing the frame when the lock assembly is installed on the frame, and the mating means is a peg projecting from the frame which is dimensioned to be inserted in the cavity.

14. A lock assembly as defined in claim 1, wherein the pivotal attachment means includes a fastener and a spring, and wherein the block has an aperture having a shoulder which defines a larger cavity adjacent a surface of the block away from the frame when installed, said fastener having a head end opposing said shoulder, the spring being mountable within the larger cavity between the shoulder and the head of the fastener.

15. A lock assembly as defined in claim 1, wherein the block has two symmetrical lock surfaces.

16. A lock assembly as defined in claim 1, wherein the block is of sufficient transverse dimension to function as a handle for manipulating the lock assembly from its anchored position to its unanchored position.

17. A lock assembly as defined in claim 1, wherein the lock is provided with rounded corners at the end adjacent the pivot point, to provide clearance between the block and the fixed panel when the block is pivoted.

18. A lock assembly as defined in claim 1, further comprising a mounting template having a projection extending therefrom for engaging the anchor means.

19. A lock assembly as defined in claim 1, wherein the block includes means for providing clearance between the block and mounting tracks or other obstruction located on the frame along the length of the fixed panel.

20. A lock assembly as defined in claim 1, wherein at least the side of the block positioned adjacent the panels when the block is mounted and in its anchor position has formed therein a transverse shoulder which forms the lock surface.

21. A lock assembly for a horizontal sliding sashless window assembly having a frame including a lower horizontal sill with said frame defining a window opening; a fixed sashless pane disposed within said frame and covering a portion of said window opening and a sliding sashless pane received within said frame and slideable on said sill between a closed position with said sliding pane covering an exposed portion of said opening not covered by said fixed pane and said sliding pane horizontally slideable to an open position to open said exposed portion; said fixed and sliding pane disposed within said frame and sized such that said sliding pane has a portion thereof overlapping said fixed pane when in said closed position and terminating at a generally vertical leading edge adjacent said fixed pane with said overlapping portion increasing in size as said sashless pane is moved to an open position; and with said sliding pane free for limited vertical movement within said frame; said lock assembly comprising:

a block;

pivot means for pivotally securing said block to said sill to pivot about a vertical axis disposed opposing said leading edge when said sliding pane is in a closed position and with said block pivotable between a locked position and unlocked position;

said block shaped that when in said locked position to present a generally vertical lock surface opposing said leading edge with said vertical lock surface having a horizontal dimension substantially equal to a horizontal dimension of said leading edge; said block further provided with a shoulder having a blocking surface opposing a vertical surface of said sliding pane generally parallel to said direction of sliding movement; said lock surface spaced from said leading edge a distance to present a clearance with said lock surface free to pass through said clearance as said block is pivoted from said locked position to said unlocked position;

anchor means for restraining said block from pivotable movement when said block is in said locked position comprising cooperating mating elements on said block and said sill with said mating elements slideably movable relative to one another in a straight vertical line between a captured position and a free position; said elements in said free position free to move relative to one another in a direction perpendicular to said pivotal axis and with said elements in said captured position restrained from movement relative to one another in a direction other than along said straight vertical line;

said pivot means in said block provided with mating vertical sliding surfaces permitting vertical sliding movement of said entire block away from said sill in a direction parallel to said straight vertical line of movement of said anchor means mating elements with said pivot means mating surfaces permitting vertical movement at said pivot axis a distance that is at least as great as a stroke of said anchor means between said capture and free positions;

stop means restraining vertical sliding movement of the block from the sill from moving more than a predetermined maximum distance; and a spring engaging said pivot means and said block for biasing said block toward the sill and resisting vertical sliding movement of said block away from said sill.

22. A lock assembly as defined in claim 2, wherein the block is formed with two symmetrically formed and located shoulders so that the assembly can be mounted for use with a sliding panel mounted on either side of the fixed panel.

23. A lock assembly as defined in claim 2, wherein the anchor is a peg for engaging a hole in the sill.

24. A lock assembly as defined in claim 2, wherein the anchor is a cavity for engaging a peg projecting outwardly from the surface of the sill.

25. A lock assembly as defined in claim 2, wherein the blocking surface is provided with a resilient pad for compression against the side of the sliding pane, thereby tending to force the sliding pane into contact with the overlapping fixed pane.

26. A lock assembly as defined in claim 2, wherein the forward end of the block is provided with rounded vertical corner surfaces.

* * * * *